United States Patent [19]

Musto

[11] 4,274,601

[45] Jun. 23, 1981

[54] IMP MILL HAVING ADJUSTMENT MEANS

[75] Inventor: Richard L. Musto, Homewood, Ill.

[73] Assignee: Combustion Engineering, Inc., Windsor, Conn.

[21] Appl. No.: 59,704

[22] Filed: Jul. 23, 1979

[51] Int. Cl.[3] ..... B02C 13/286; B02C 13/288

[52] U.S. Cl. ..... 241/186.2; 241/188 R

[58] Field of Search ..... 241/186 R, 186.2, 188 R, 241/189 R, 189 A

[56] References Cited

U.S. PATENT DOCUMENTS

| | | | |
|---|---|---|---|
| 1,603,520 | 10/1926 | Crites et al. | 241/186 R X |
| 1,765,309 | 6/1930 | O'Neill | 241/186 R X |
| 1,767,921 | 6/1930 | Gately | 241/186.2 |
| 3,490,705 | 1/1970 | Ruckstuhl | 241/186 R |

*Primary Examiner*—Howard N. Goldberg
*Attorney, Agent, or Firm*—Arthur E. Fournier, Jr.

[57] ABSTRACT

An imp mill having adjustment means, which is particularly suited for the fine and medium-fine grinding of softer non-metallic minerals and coal. The subject imp mill includes a housing that defines a grinding chamber having an inlet and an outlet. A multiplicity of swing-hammers are suitably mounted on a rotatable shaft for rotation within the grinding chamber whereby the swing-hammers are operable to effect the grinding of material located within the grinding chamber. The aforesaid shaft passes through the grinding chamber substantially at the center thereof and is externally driven by a suitable drive means. The imp mill further includes inlet means suitably supported on the housing so as to communicate with the inlet of the grinding chamber. The inlet means is operable to supply to the interior of the grinding chamber the material to be ground therein. There is also provided outlet means suitably supported on the housing so as to communicate with the outlet of the grinding chamber. The outlet means is operable to effect the discharge of the ground material from the grinding chamber. An adjustment means is suitably supported for relative movement within the outlet means at the entrance thereof such that the adjustment means is located in juxtaposed relation to the outlet of the grinding chamber. The degree of fineness to which the material is ground in the grinding chamber can be adjusted by varying the relative position of the adjustment means, while the mill is in operation.

6 Claims, 3 Drawing Figures

IMP MILL HAVING ADJUSTMENT MEANS

BACKGROUND OF THE INVENTION

This invention relates to apparatus employable for grinding materials and, more specifically, to an imp mill particularly suited for the fine and medium-fine grinding of non-metallic minerals and coal, which is provided with adjustment means whereby the degree of fineness to which the material is ground can be adjusted.

It has long been known in the prior art to provide apparatus employable for purposes of effecting the grinding of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part, to the diverse functional requirements that are associated with the specific applications in which such apparatus are designed to be employed. For instance, in the selection of the particular type of apparatus that is to be utilized for a specific application one of the principal factors to which consideration must be given is that of the nature of the material that is to be ground in the apparatus. Another factor to which consideration must be given is that of the fineness to which it is desired to grind the material.

One form of apparatus, which has long been utilized in the prior art, as a means of effecting the grinding of a variety of different types of material is that commonly referred by applicant's assignee as an imp mill. Namely, the latter, which, generally speaking, may be viewed as being a particular type of hammermill, is one of the forms of pulverizers commonly employed for reducing the size of minerals, organics and chemicals. In accord with the mode of operation thereof, it is normally swept by air to remove the pulverized, i.e., ground, product, which is ordinarily reduced therein in size from three-quarter inch lumps to finenesses wherein all of the pulverized product is capable of passing through a 20 mesh screen to finenesses wherein all of the pulverized product is capable of passing through a 325 mesh screen. Basically, such mills consist of swing-hammers that are suitably pinned to discs, which, in turn, are attached to a rotor shaft that is housed in a cylindrical grinding chamber. Commonly, the rotor shaft is supported in a horizontal plane, and the grinding chamber has an air inlet provided on one end and an air outlet provided on the other end so that the air, which sweeps through the mill, flows parallel to the rotor shaft.

One of the earliest uses to which imp mills were put was that of the pulverization of coal, and particularly in those applications wherein it was desired to pulverize the coal for direct firing. However, as these systems in which direct firing of pulverized coal is employed have grown larger, there has been a concomitant increase in the amount of pulverized coal that is required to be supplied thereto. Thus, it has now been found that in many instances the demands of such direct firing systems for pulverized coal exceeds the capacity of the imp mills to provide the pulverized coal. Consequently, other forms of pulverizing equipment are now being utilized in such applications, i.e., those which require larger amounts of pulverized coal. Nonetheless, imp mills continue to be employed to provide the amounts of pulverized coal required in smaller capacity installations, such as those wherein the direct firing of the pulverized coal takes place in rotary kilns, rotary dryers or industrial furnaces.

Another application in which it has been known to utilize imp mills is in the clay fields of Kentucky and Tennessee wherein the mills are employed to effect the grinding of the clay materials, which are to be found thereat. Imp mills are also widely used in the complete processing of such products as organic insecticides, soya flour, starches, litharge for storage batteries, phosphate materials, synthetic resins, potassium compounds and in literally dozens of other applications in which precision grinding and drying are an important part of the production process.

There are many factors that affect the fineness of grind that an imp mill is capable of providing. Among these factors there are to be found included the following: mill speed, size of the swing-hammers, the number of swing-hammers, and the clearance which exists between the tips of the swing-hammers and the grinding chamber. Any or all of the above may be varied separately or collectively to effect a change in the grinding characteristics of the mill. However, the most critical factor, which determines the mill performance in terms of its grinding characteristics, in the relationship that the grinding chamber periphery bears to the air outlet.

Namely, if the entrance to the air outlet is in line, i.e., coextensive, with the periphery of the grinding chamber, the mill is incapable of producing a fine grind of material irrespective of whether the other above-recited factors are varied. On the other hand, if the entrance to the air outlet is offset towards the center line of the mill, i.e., is not coextensive with the periphery of the grinding chamber, the mill will produce a very fine grind and will be incapable of providing a coarse grind. Essentially, the reason why the imp mills performs in the aforedescribed manner is that in order for the material to be ground fine, it must be retained in the grinding chamber for a longer period of time. Consequently, in the situation wherein the entrance to the air outlet is coextensive with the periphery of the grinding chamber, the material once it has reached the exit side of the grinding chamber is free to flow into the air outlet, and thereby leave the grinding chamber. However, in the case wherein the entrance to the air outlet is offset towards the center line of the grinding chamber, the portion of the side wall of the grinding chamber that is formed by virtue of the aforesaid offset relationship of the air outlet to the periphery of the grinding chamber is operative as a dam, i.e., barrier or abutment, to the flow of material from the grinding chamber. Namely, some of the material upon reaching the exit side of the grinding chamber encounters for aforementioned dam and is prevented thereby from flowing into the air outlet, i.e., from exiting from the grinding chamber. Instead, the material that is blocked by the aforesaid barrier is made to remain in the grinding chamber for a longer period of time, during which it is subjected to additional grinding, before this material passes into the air outlet. Therefore, in summary, the offset in the grinding chamber-air outlet relationship becomes a retaining dam, which forces material to remain longer within the grinding chamber with the result that a finer grind of material is generated.

Heretofore, the practice commonly followed in the industry was to provide a different model of imp mill according to the fineness of grind that was desired. To this end, there existed a so-called fine grind imp mill and a so-called coarse grind imp mill. Thus, depending on the nature of the application in which the imp mill was intended to be employed, the appropriate model of imp mill would be selected for use therein. Thereafter, the specific degree of fineness that was desired, within relatively restricted limits, could be obtained by varying one or more of the plurality of factors that have been referred to previously hereinabove. However, as alluded to above earlier, because of the nature of the construction thereof, it is not possible through simply varying the afore-referenced factors, to transform an imp mill designed as a fine grind mill into a coarse grind mill or visa versa to transform a coarse grind mill into a fine grind mill.

A further disadvantage associated with the employment of such separate fine grind mills and coarse grind mills stems from the limitations inherent therein as to the extent to which variations in degree of fineness can be effected therewith. Namely, it is desirable to be able to maintain a constant degree of fineness of grind even as the mill wears. To this end, it is readily known that the fineness of the product of an imp mill will fall off rapidly with wear of the swing-hammers and grinding chamber liners. As a consequence of this, in many applications such wear may require the mill to be shut down frequently, sometimes only after a relatively few days of operation, in order to replace the swing-hammers.

Thus, there has been evidenced in the prior art a need for a new and improved imp mill that would be capable of selectively functioning as either a fine grind mill or a coarse grind mill as needed to meet the requirements of a variety of applications. Namely, rather than employing different models of imp mills depending on whether a given application involves grinding material to a fine grind or to a coarse grind, a need has existed for a single imp mill that could be utilized as either a fine grinder or a coarse grinder. Also, a need has been demonstrated for such an imp mill that would embody the additional capability of being able to be adjusted during operation as required so as to maintain a constant fineness of grind of the product as the mill wears.

It is, therefore, an object of the present invention to provide a new and improved apparatus, which is employable for grinding material.

It is another object of the present invention to provide such a new and improved apparatus, which comprises a hammermill wherein the grinding of material is effected through the use of a multiplicity of hammers.

It is still another object of the present invention to provide such a new and improved apparatus, which comprises a particular form of hammermill; namely, an imp mill that is characterized by the fact that it is particularly suited for the fine and medium-fine grinding of non-metallic minerals and coal.

A further object of the present invention is to provide such an imp mill that embodies adjustment means operative to enable the degree of fineness to which the material is to be ground to be adjusted, while the mill is in operation, i.e., obviate the necessity of having to shut down the unit to make changes therein as required in the case of prior art mills.

A still further object of the present invention is to provide such an imp mill, which is capable of selectively functioning as either a fine grind mill or a coarse grind mill.

Yet another object of the present invention is to provide such an imp mill, which embodies the capability of enabling adjustments to be made in the degree of fineness of the grind of the material such that it is possible to maintain therewith a constant fineness of grind as the mill wears.

Yet still another object of the present invention is to provide such an imp mill that is relatively inexpensive to manufacture, relatively easy to employ, and which is capable of providing reliable operation.

SUMMARY OF THE INVENTION

In accordance with the present invention, there is provided a novel and improved imp mill embodying adjustment means operable to enable the imp mill to selectively function as either a fine grind mill or a coarse grind mill. The subject imp mill includes a cylindrical housing having a grinding chamber formed therein. Cooperatively associated with the housing so as to provide an entrance to and an exit from the grinding chamber are an inlet means and an outlet means. A multiplicity of swing-hammers are mounted for rotation within the grinding chamber and cooperate therewith to effect the grinding of material disposed within the grinding chamber. The swing-hammers are supported on a rotor shaft, which is suitably mounted so as to extend through the grinding chamber and so that the axis of rotation thereof is coincident with the center line of the cylindrical housing. Interposed between the outlet means and the grinding chamber is an adjustment means. The latter adjustment means includes a baffle member supported for movement relative to the flow path through which material after grinding in the grinding chamber flows therefrom to and through the outlet means, and means for establishing the position of the baffle member. The baffle member is mounted for movement between a first position, corresponding to a blocking position wherein the baffle member projects into the flow path of the material leaving the grinding chamber thereby forcing material through the blockage thereof to remain in the grinding chamber for a longer period of time to effect the further grinding thereof, and a second position, corresponding to a non-blocking position wherein the baffle member is removed from the path of flow of the material leaving the grinding chamber thereby enabling the material to flow freely from the grinding chamber. In addition, the baffle member is capable of being supported at any position intermediate the aforesaid first and second positions thereof thereby enabling the degree of fineness of grind to be varied as required, as for example, to compensate for mill wearing, particularly where there is a need to maintain a constant fineness of grind of the product from the mill. The subject imp mill with the baffle member located in the first position thereof is operable as a fine grind mill and with the baffle member located in the second position thereof is operable as a coarse grind mill.

DESCRIPTION OF A PREFERRED EMBODIMENT

Figure 1:
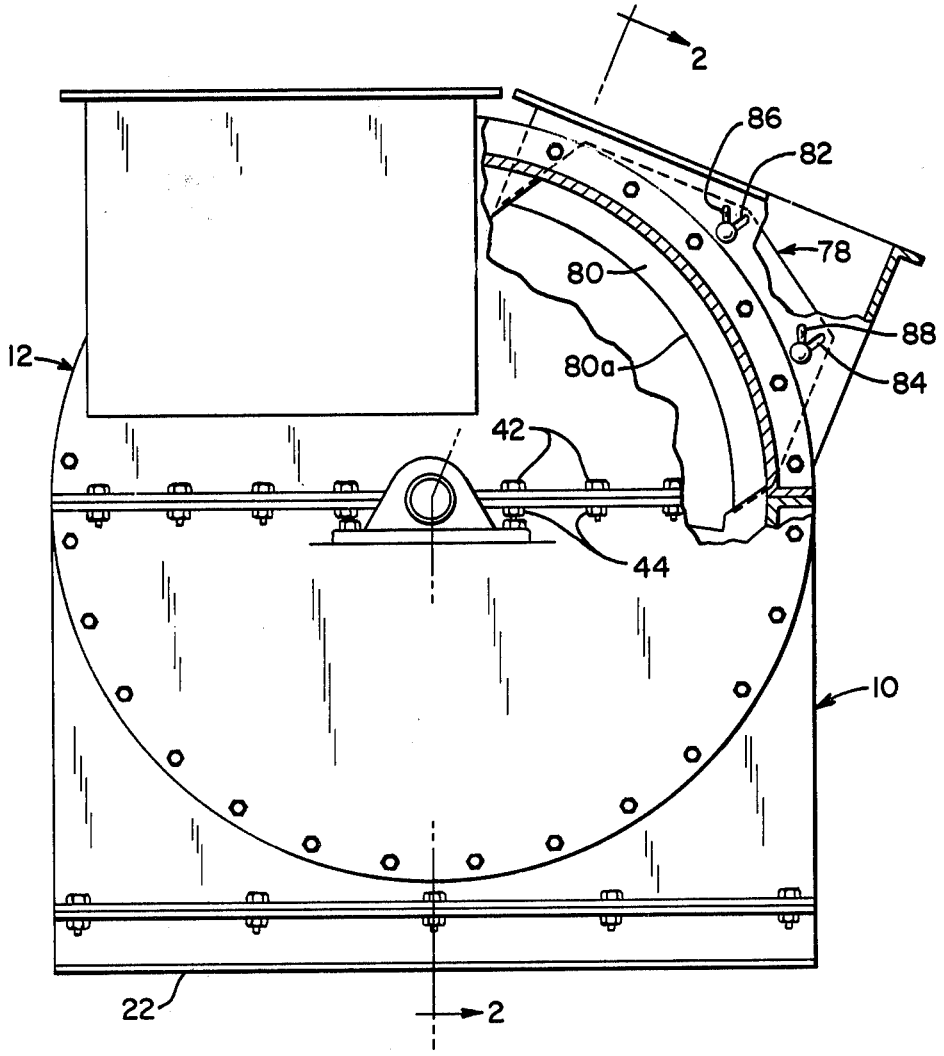
FIG. 1 is a side elevational view of an imp mill constructed in accordance with the present invention, illustrated with some parts broken away for clarity of illustration.

Referring now to the drawing and, more particularly, to FIG. 1 thereof, there is depicted therein a form of hammermill, i.e., an imp mill, generally designated by reference numeral 10, constructed in accordance with the present invention. In accord with the best mode embodiment of the invention, the imp mill 10, as best understood with reference to FIGS. 1 and 2 of the drawing, includes a housing, i.e., body, 12, the latter being generally cylindrical in configuration. More specifically, the housing 12 in accord with the illustrated embodiment thereof, consists of a pair of suitably dimensioned side cover plates 14 and 16, preferably formed of a metallic material and a circular end wall member 18 that is suitably secured to the former side cover plates 14 and 16 through the use of any suitable conventional form of securing means such that the circular end wall member 18 forms the circumference of the housing 12. The side cover plates 14 and 16 cooperate with the circular end wall member 18 to define interiorly thereof, i.e., within the housing 12, a substantially closed grinding chamber, generally designated by reference numeral 20, of substantially cylindrical configuration.

Figure 2:
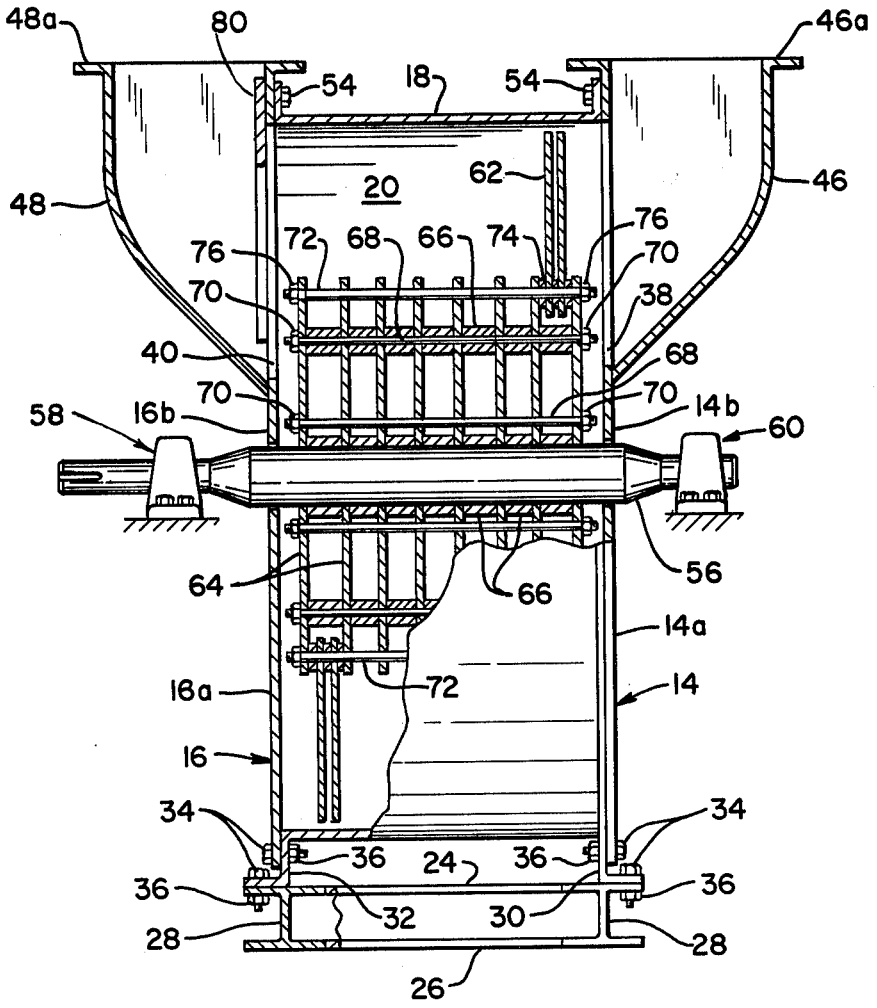
FIG. 2 is a cross-sectional view of an imp mill constructed in accordance with the present invention, taken substantially along the line 2—2 in FIG. 1 of the drawing.

Continuing with the description of the imp mill 10, the housing 12 is preferably suitably supported on a base, generally designated by reference numeral 22. The base 22, as best understood with reference to FIG. 2 of the drawing, includes a pair of parallel plate members 24 and 26 suitably supported in spaced relation one from another by means of a plurality of beam members 28, each extending substantially perpendicular to the plane of the plate members 24 and 26. The beam members 28 may be formed integrally with the plate members 24 and 26, or, alternatively, the beam members 28 may be suitably joined to the plate members 24 and 26 through the use of any suitable conventional form of securing means. As depicted in FIG. 2 of the drawing, the interconnection of the housing 12 to the base 22 may be effected through the use of a pair of upstanding members 30 and 32 extending longitudinally substantially the entire length of the side cover plates 14 and 16. More specifically, the pair of upstanding members 30 and 32 are suitably fastened to the side cover plates 14 and 16, respectively, and to the plate member 24 through the use of conventional fastening means consisting of a multiplicity of threaded fasteners 34 that are each threadedly received within a corresponding cooperating nut 36.

With further reference particularly to FIGS. 1 and 2 of the drawing, in accordance with the best mode embodiment of the invention, the side cover plates 14 and 16 are each preferably of two-part construction. Namely, the side cover plates 14 and 16 each include a lower half **14*a* and 16*a*, respectively, and an upper half 14*b* and 16*b*, respectively. Moreover, the lower halves 14*a* and 16*a* are preferably fastened to the upper halves 14*b* and 16*b*, respectively, through the use of conventional fastening means such as the multiplicity of threaded fasteners 42, which are each threadedly engaged in a corresponding cooperating threaded nut 44, in the manner depicted in FIG. 1**.

Further, in accord with the best mode embodiment of the invention, the housing 12 is preferably provided with a pair of openings 38 and 40, suitably formed in the side cover plates 14 and 16, respectively. The openings 38 and 40 function, respectively, as the inlet and the outlet from the grinding chamber 20. As viewed with reference to FIG. 2, the inlet opening 38 and the outlet opening 40 are located in the upper halves **14*b* and 16*b*, respectively, of the corresponding side cover plates 14 and 16. Moreover, as best understood with reference to FIG. 3 of the drawing, the openings 38 and 40 are suitably positioned relative to each other so as to be located on opposite sides of the center line of the cylindrical housing 12. In a manner yet to be described, the inlet opening 38 and the outlet opening 40 are cooperatively associated with the grinding chamber 20 so as to function therewith to provide a path of flow through the grinding chamber 20** for the material that is to be ground therein.

Figure 3:
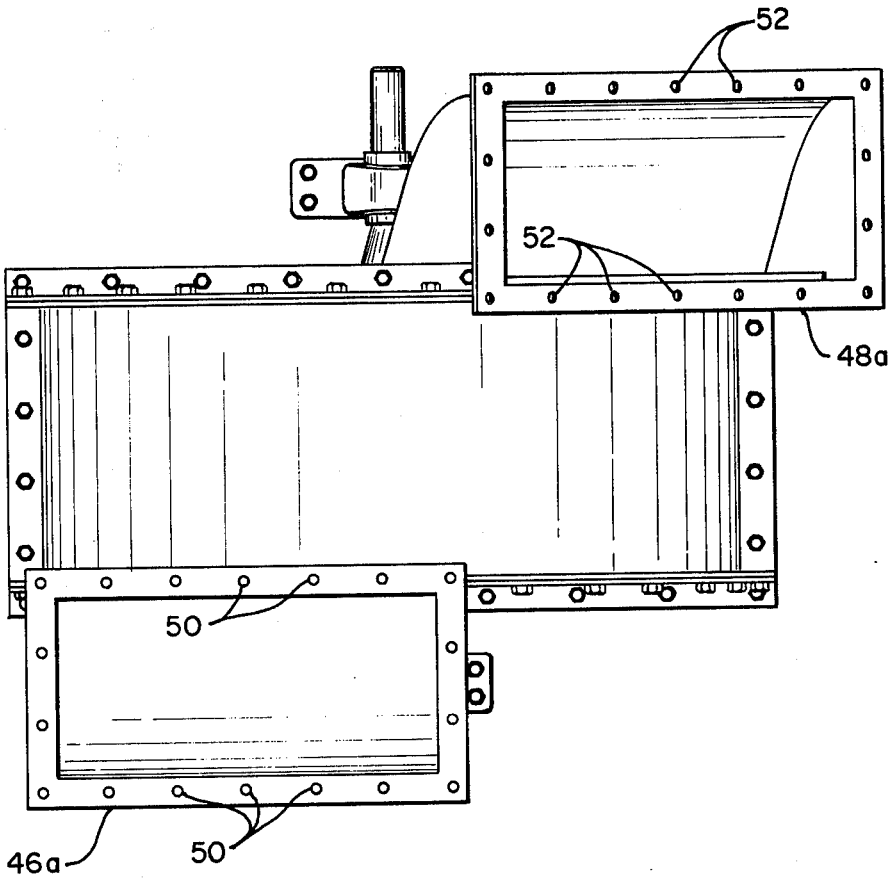
FIG. 3 is a top plan view of an imp mill constructed in accordance with the present invention.

As best understood with reference to FIG. 2 of the drawing, an inlet duct 46 is provided in cooperative association with the inlet opening 38 and an outlet duct 48 is provided in cooperative association with the outlet opening 40. To this end, the inlet duct 46 and the outlet duct 48 project outwardly away from the plane of the side cover plates 14 and 16, respectively. Moreover, the inlet duct 46 and the outlet duct 48 each have one end thereof, which is essentially coterminous with the circumference of the inlet opening 38 and the outlet opening 40, respectively. The other end of both of the inlet duct 46 and the outlet duct 48 are designed to be suitably connected, respectively, in fluid flow relation with a suitable source (not shown) of material to be ground in the imp mill 10, and a means (not shown) located downstream of the imp mill 10 to receive from the latter the material after grinding. In this regard, as shown in FIG. 3 of the drawing, the free end of both the inlet duct 46 and the outlet duct 48, preferably terminate in a flange **46*a* and 48*a*, respectively, each having a multiplicity of corresponding openings 50 and 52 formed therein for receiving conventional fastening means operable to effect the interconnection of the inlet duct 46 and the outlet duct 48** to other components.

In accord with the best mode embodiment of the invention, the inlet duct 46 and the outlet duct 48 are each secured to the side cover plates 14 and 16, respectively, in the following manner. Namely, the end of both the inlet duct 46 and the outlet duct 48, which are coterminous with the inlet opening 38 and the outlet opening 40, respectively, are preferably secured to the upper halves **14*b* and 16*b*, respectively, of the corresponding side cover plates 14 and 16 such as by being welded thereto. In addition, as illustrated in FIG. 2 of the drawing, preferably the free end of both the inlet duct 46 and the outlet duct 48 are fastened also to the housing 12 by means of fastening means consisting of threaded fasteners 54. Obviously, however, the interconnection of the free end of both the inlet duct 46 and the outlet duct 48 to the housing 12** could be effected in some other way, i.e., by utilizing some other conventional form of securing means, without departing from the essence of the present invention.

Continuing with the description of the nature of the construction of the imp mill 10, the latter further includes a rotor shaft, generally designated by reference numeral 56, which is mounted for rotation within the housing 12. More specifically, the rotor shaft 56 extends through the housing 12 such that the axis of rotation thereof is substantially coincident with the center line of the housing 12. As depicted in FIGS. 2 and 3 of the drawing, the ends of the rotor shaft 56 project outwardly of the housing 12. To this end, it is to be understood that each of the side cover plates 14 and 16 is provided with a suitably dimensioned opening, the latter being undesignated by a reference numeral in the drawing in the interest of maintaining clarity of illustration therein, through which the rotor shaft 56 passes. In a manner well known to those skilled in the art, the ends of the rotor shaft 56 are preferably supported in a fixed pillow block 58 and a floating pillow block 60, respectively. Inasmuch as both the fixed pillow block 58 and the floating pillow block 60 are of conventional construction, it is not deemed necessary for purposes of obtaining an understanding of the present invention to describe herein and/or illustrate in the drawing the details of construction thereof. Finally, the rotor shaft 56 is preferably driven by means of a conventional drive motor (not shown) located externally of the imp mill 10 that is suitably cooperatively associated with the end of the rotor shaft 56, which is supported in the fixed pillow block 58.

Referring again to FIG. 2 of the drawing, as illustrated therein, the rotor shaft 56 has a multiplicity of hammers 62 mounted thereon for rotation therewith. More specifically, in accord with the best mode embodiment of the invention, a multiplicity of mill discs 64 are mounted on the rotor shaft 56 for rotation therewith. To this end, each of the mill discs 64 has an opening (not shown) suitably formed at the center thereof that is suitably dimensioned for receiving the rotor shaft 56 therein. Moreover, the mill discs 64 are positioned on the rotor shaft 56 in suitably spaced relation one to another through the use of a plurality of disc spacers 66, there being one such disc spacer 66 interposed between each pair of mill discs 64. In addition, the mill discs 64 are preferably interconnected one to another by means of a plurality of tie rods 68. The latter tie rods 68 are positioned so as to extend in spaced, parallel relation to the axis of rotation of the rotor shaft 56. Furthermore, the tie rods 68 are preferably received in openings (not shown) suitably provided for this purpose in each of the mill discs 64. Finally, preferably, the ends of each of the tie rods 68 are threaded for purposes of receiving thereon suitably threaded nuts 70 in tightened threaded engagement therewith.

Located adjacent the peripheries of the mill discs 64, there are positioned, in accord with the best mode embodiment of the invention, a plurality of hammer pins 72. The latter hammer pins 72 are suitably supported in openings (not shown) provided for this purpose in the mill discs 64 such that each of the hammer pins 72 extends substantially parallel to the axis of rotation of the rotor shaft 56. The multiplicity of hammers 62 to which reference has previously been had hereinabove are suitably supported in spaced relation one to another on the hammer pins 72. To this end, a hammer spacer 74 is interposed between each pair of hammers 62. In the interest of maintaining clarity of illustration in the drawing, some of the hammer spacers 74 have been omitted in FIG. 2. The ends of each of the hammer pins 72 are preferably threaded for purposes of receiving thereon suitably threaded nuts 76 in tightened, threaded engagement therewith. The hammer spacers 74 cooperate with the peripheral surfaces of the mill discs 64 to maintain the hammers 62 fixedly positioned one to another on the hammer pins 72, i.e., to prevent the hammers 62 from undergoing lateral movement.

Completing the description of the nature of the construction of the imp mill 10, in accord with the present invention, the latter is provided with adjustment means, generally designated by reference numeral 78. The adjustment means 78 includes a baffle member 80 and mounting means operative for mounting the baffle member 80 for movement within the imp mill 10. As best understood with reference to FIG. 1 of the drawing, the baffle member 80 embodies an arcuate edge **80*a*, the radius of curvature of which is selected to be such that it is substantially the same as the radius of curvature of the circular end wall member 18. In accord with the best mode embodiment of the invention, the baffle member 80, as depicted in FIG. 2 of the drawing, is positioned within the outlet duct 48 so as to be movable between a blocking and a nonblocking position relative to the path of flow of material leaving the grinding chamber 20 after the grinding thereof therein and entering the outlet duct 48 for discharge from the imp mill 10. More specifically, as viewed with reference to FIG. 2 of the drawing, the baffle member 80 is mounted for movement in a vertical plane such that it moves substantially perpendicular to the path of flow of the material as the latter flows from the grinding chamber 20 to the outlet duct 48**.

As best understood with reference to FIG. 1 of the drawing, the means employed for mounting the baffle member 80 includes a pair of suitably dimensioned slots 82, 84 formed in spaced relation one to another in the upper portion of the inner wall of the outlet duct 48. The aforesaid slots 82, 84 are designed to each receive therein in sliding relation thereto a cooperating handle nut 86, 88, respectively. The handle nuts 86, 88 are suitably affixed through the use of any conventional form of fastening means (not shown) to the baffle member 80. The handle nuts 86, 88 are operative to establish the position of the baffle member 80 relative to the open passage that interconnects the grinding chamber 20 with the outlet duct 48, i.e., establishes the path of flow of the material from the grinding chamber 20 to the outlet duct 48.

To this end, the handle nuts 86, 88 may be located at either end of the slots 82, 84, respectively, or at any location intermediate the ends of the slots 82, 84. As will be described more fully hereinafter, with the handle nuts 86, 88 occupying the positions illustrated in FIG. 1 of the drawing, the baffle member 80 is mounted in the blocking position thereof whereby the baffle member 80 is operative in the manner of an abutment to impede the flow of material from the grinding chamber 20 to the outlet duct 48. As such, the material upon encountering the baffle member 80 is made to remain in the grinding chamber 20 whereupon it undergoes further grinding. Accordingly, with the handle nuts 86, 88 positioned as shown in FIG. 1 of the drawing, the imp mill 10 is operative in the manner of a fine grinder. On the other hand, with the handle nuts 86, 88 located at the opposite ends of the slots 82, 84, respectively, from that depicted in FIG. 1, the baffle member 80 would occupy the non-blocking position thereof whereby material would be free to flow from the grinding chamber 20 to the outlet duct 48, and, thus, the imp mill 10 would be operative in the manner of a coarse grinder.

A description will now be had of the mode of operation of the imp mill 10. With the inlet duct 46 of the imp mill 10 connected to a suitable source of grindable material and the outlet duct 48 of the imp mill 10 connected to a suitable receiver of ground material, the material to be ground in the imp mill 10 enters the inlet duct 46 from whence it flows into the grinding chamber 20. In accordance with conventional practice, the grindable material that enters the grinding chamber 20 is preferably accompanied by a suitable flow of air. In the grinding chamber 20, the material is ground through the engagement thereof with the hammers 62. Namely, as the material flows through the grinding chamber 20 from the inlet duct 46 to the outlet duct 48, it encounters the hammers 62 and is pulverized thereby. Upon reaching the outlet duct 48, the material, which has now been pulverized in the grinding chamber 20 by the hammers 62, either passes thereinto for subsequent discharge from the imp mill 10 or else the material is prevented from passing into the outlet duct 48, depending on whether the baffle member 80 is in the nonblocking or the blocking position thereof. Assuming that the baffle member 80 occupies the blocking position thereof, i.e., the baffle member 80 and the handle nuts 86, 88 occupy the positions depicted in FIG. 1, the material is prevented from immediately leaving the grinding chamber 20 whereupon it undergoes further grinding within the grinding chamber 20 such that the material, upon being discharged from the imp mill 10, is of a fine grind. It is to be understood that the path of flow of the material through the grinding chamber 20 is substantially parallel to the rotor shaft 56. Concomitantly, the path of flow of the air that sweeps through the imp mill 10 in the course of which it assists in the conveyance of the material therethrough is also substantially parallel to the axis of rotation of the rotor shaft 56. Finally, from the above description of the imp mill 10, it should be readily apparent that the imp mill 10 can be made to function either as a fine grinder or as a coarse grinder simply through the selective positioning of the baffle member 80, i.e., by positioning the baffle member 80 either in the blocking position or the non-blocking position thereof by making use of the handle nuts 86, 88. Moreover, as the hammers 62 wear, within limits, a constant degree of fineness can be maintained simply by adjusting the position that the handle nuts 86, 88 occupy within the slots 82, 84, respectively. It is to be noted here that such adjustments to maintain the degree of fineness of the grind are in addition to adjustments which are always available through the use of changes in mill speed, etc. In summary, the degree of fineness to which the material is ground in the grinding chamber 20 can be adjusted by varying the relative position of the adjustment means, which adjustment can be effected while the mill is operating.

Thus, in accordance with the present invention, there has been provided a new and improved apparatus, which is employable for grinding materials. Moreover, the subject apparatus of the present invention comprises a hammermill wherein the grinding of material is effected through the use of a multiplicity of hammers. In addition, in accord with the present invention, an apparatus is provided which comprises a particular form of hammermill; namely, an imp mill that is characterized by the fact that it is particularly suited for the fine and medium-fine grinding of non-metallic minerals and coal. Further, the imp mill of the present invention embodies adjustment means operative to enable the degree of fineness to which the material is to be ground to be adjusted. Additionally, in accordance with the present invention, an imp mill is provided which is capable of selectively functioning as either a fine grind mill or a coarse grind mill. Also, the imp mill of the present invention embodies the capability of enabling adjustments to be made in the degree of fineness of the grind of the material such that it is possible to maintain therewith a constant fineness of grind as the mill wears. Furthermore, in accord with the present invention, an imp mill is provided that is relatively inexpensive to manufacture, relatively easy to employ, and which is capable of providing reliable operation.

While only one embodiment of my invention has been shown, it will be appreciated that modifications thereof, some of which have been alluded to hereinabove, may still be readily made thereto by those skilled in the art. I, therefore, intend by the appended claims, to cover the modifications alluded to herein as well as all other modifications, which fall within the true spirit and scope of my invention.

What is claimed is:

1. An apparatus that is particularly suited for the fine and medium-fine grinding of softer nonmetallic minerals and coals, and which is capable of selectively being operated as either a fine grinder or a coarse grinder, comprising:

a. a housing having a grinding chamber formed therewithin, a first opening communicating with said grinding chamber and operable as an inlet thereto, and a second opening communicating with said grinding chamber and operable as an outlet therefrom;

b. inlet means having one end thereof connected in fluid flow relation with said first opening and having the other end thereof connectable to a source of grindable material, said inlet means being operative to provide grindable material from the supply thereof to said grinding chamber;

c. grinding means supported within said grinding chamber, said grinding means operative to effect the grinding of the grindable material disposed within said grinding chamber;

d. outlet means comprising an outlet duct having first and second ends, said first end being joined to said housing in juxtaposed relation to said second opening for receiving ground material from said grinding chamber after the grinding thereof therewithin, said second end terminating in a flange capable of being connected to a receiver of ground material; and e. adjustment means cooperatively associated with said outlet means, said adjustment means including a plate-like baffle member and mounting means mounting said plate-like baffle member in said outlet duct in juxtaposed relation to said second opening such that said plate-like baffle member is slidably movable in a plane parallel to the plane defined by the diameter of said second opening, said plate-like baffle member having an arcuate edge embodying a radius of curvature corresponding to the radius curvature of said second opening, said mounting means including a pair of spaced slots formed in said outlet duct adjacent to said first end thereof and a pair of fasteners fixedly attached to said plate-like baffle member, said pair of fasteners being received in said pair of spaced slots for sliding movement therewithin, said pair of fasteners when positioned at a first location within said pair of spaced slots being operative to position said plate-like baffle member relative to said second opening such that said arcuate edge of said plate-like baffle member projects into said second opening thereby defining an abutment relative thereto operative to impede the flow of material through said second opening from said grinding chamber and thereby causing the apparatus to operate as a fine grinder, said pair of fasteners when positioned at a second location within said pair of spaced slots being operative to position said plate-like baffle member relative to said second opening such that said arcuate edge of said plate-like baffle member is coterminous with the periphery of said second opening thereby enabling material to freely flow through said second opening from said grinding chamber and thereby causing the apparatus to operate as a coarse grinder.

2. An apparatus as set forth in claim 1 wherein said housing includes a pair of side cover plates and a circular end wall member joined to said pair of side cover plates so as to provide said housing with a generally cylindrical configuration, each of said pair of side cover plates being of two-part construction so as to embody an upper half and a lower half, said first opening being formed in said upper half of one of said pair of side cover plates, said second opening being formed in said upper half of the other of said pair of side cover plates.

3. An apparatus as set forth in claim 1 wherein said inlet means comprises an inlet duct having first and second ends, said first end being joined to said housing in juxtaposed relation to said first opening, said second end terminating in a flange for connection to a supply of grindable material.

4. An apparatus as set forth in claim 1 wherein said grinding means includes a rotor shaft supported for rotation within said grinding chamber and a multiplicity of grinding members supported on said rotor shaft for rotation therewith, said rotor shaft having its axis of rotation coincident with the center line of said housing.

5. An apparatus as set forth in claim 4 wherein said grinding means further includes a multiplicity of mill discs supported on said rotor shaft for rotation therewith and a plurality of hammer pins supported on said multiplicity of mill discs adjacent to the periphery thereof.

6. An apparatus as set forth in claim 5 wherein said multiplicity of grinding members comprises a multiplicity of hammers fixedly mounted on said plurality of hammer pins.

* * * * *